United States Patent [19]

Hall

[11] 4,122,695

[45] Oct. 31, 1978

[54] LOCK HEAD PROTECTOR

[75] Inventor: Mitchell A. Hall, Ft. Thomas, Ky.

[73] Assignee: Monarch Tool & Manufacturing Company, Covington, Ky.

[21] Appl. No.: 835,139

[22] Filed: Sep. 21, 1977

[51] Int. Cl.[2] ..... E05B 15/16

[52] U.S. Cl. ..... 70/417

[58] Field of Search ..... 70/417, 381, 452, 231

[56] References Cited

U.S. PATENT DOCUMENTS

| | | | |
|---|---|---|---|
| 2,047,966 | 7/1936 | Jacobi | 70/417 |
| 2,225,703 | 12/1940 | Machinist | 70/417 |
| 3,630,054 | 12/1971 | Malminen | 70/381 |
| 3,751,953 | 8/1973 | Newman | 70/381 |
| 3,850,014 | 11/1974 | Flack | 70/417 |
| 4,008,588 | 2/1977 | Miller | 70/417 |

*Primary Examiner*—Robert L. Wolfe

*Attorney, Agent, or Firm*—J. Warren Kinney, Jr.

[57] ABSTRACT

A hardened protective housing is rotatably secured to the outer head of a cylindrical lock for precluding access to and mistreatment of said head for rendering the lock ineffective for its intended purpose.

12 Claims, 11 Drawing Figures

LOCK HEAD PROTECTOR

BACKGROUND OF THE INVENTION

1. Field of the Invention

The field of the invention relates to protective means for the external head of key-actuated cylinder locks of the type which are secured to and carried by the front panel of coil boxes of coin-actuated devices, and the like.

2. Description of the Prior Art

Heretofore the external head of key-actuated cylinder locks have been provided with a hardened collar which circumscribes and projects forwardly over the external lock head whereby to effectively prevent the filing or chipping away of the head for reducing its outer diameter to a dimension such that the head-end of the lock cylinder can be pushed through the lock-cylinder-receptive-aperture in the front panel of a coin box, or the like, thereby rendering the lock ineffective and useless.

While the use of such hardened collars has prevented vandals from filing or chipping away the external head of cylinder locks, such collars function as a "guide" for the cutting edge of a hollow mill or hole-saw which effectively cuts away those portions of the external head of the cylinder lock which project beyond the confines of the lock-receptive aperture in the front panel of a coin box. In other words, by using a hollow mill, hole-saw, or the like the diameter of the external head is reduced to a dimension such that the head-end of the lock cylinder can be pushed into the coin box for thereby defeating the function of the lock.

Once a lock has thus been disabled and dislodged from its supporting panel, the coin box may be easily opened, and its contents removed along with the "disabled" lock. The lock may then be removed from the premises and utilized to make a duplicate key for that particular lock and all like it, that is said duplicate key will be effective in opening, that is unlocking, all of the other locks of a battery of coin-controlled mechanisms such as, by way of example, washers, driers, vending machines, and the like; and since the coin box, per se, is not damaged by the lock-removing procedure, the vandals replace the cylinder lock which was removed, with another complete cylinder lock which has an intact external head to match the external head of the "removed" lock, whereby the lawful owners and authorized service personnel of the coin-actuated devices are unaware of the fact that their coin boxed are being pilfered at will by vandals.

DESCRIPTION OF THE PREFERRED EMBODIMENTS

Figure 1:
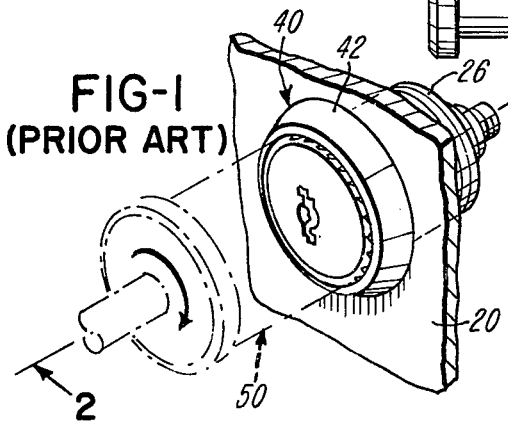
FIG-1 (PRIOR ART)
FIG. 1 is a front perspective view of a typical lock assembly which embodies the teachings of the prior art.

In the drawings, the numeral 20 designates, in each instance, the front panel of a coin-box, drawer or a compartment in which money or other valuables are housed, wherein authorized access to said coin box, drawer or compartment is controlled by means of a key-actuated cylinder lock 22 which comprises an external head 24 which is of a larger diameter than the elongate, substantially cylindrical cylinder, or lock body 26. The lock cylinder is adapted to be received within an aperture 30 of the front panel 20, said lock body being provided with screw threads 32 which are engageable by the internal threads of a retaining nut 34 which, when tightened upon the threaded portion of the lock cylinder draws the rear surface A of the external lock head 24 toward and/or tightly against portions of the outer surface B of panel 20, whereby said lock is secured to and carried by panel 20.

Figure 2:
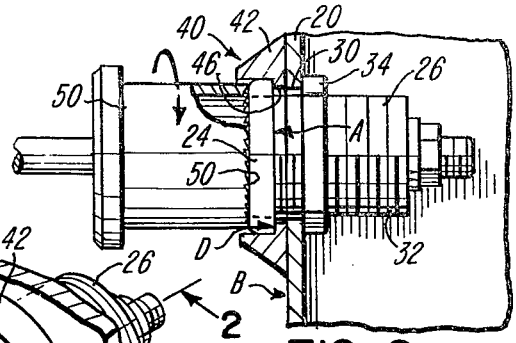
FIG-2 (PRIOR ART)
FIG. 2 is a sectional view taken on line 2—2 of FIG. 1 illustrating the manner in which the hardened collar of the prior art, which circumscribes the external head of the lock cylinder, functions as a guide for a hollow mill or holesaw.

Heretofore the industry has resorted to the use of a hardened collar 40 of FIGS. 1 and 2 which included a forwardly projecting portion 42 which completely circumscribed the external head 24 of the lock, it being noted that the hardened collar included a peripheral flange 46 which was disposed between the rear surface A of the external head 24 and forward surface B of front panel 20, whereby said hardened protective flange was secured relative to the forwardly projecting head 24 of the lock. The presence of hardened collar 40 effectively precluded access to the side surfaces of the external head 24 of the lock, thereby preventing said head from being subjected to a filing or chipping action for reducing the diameter of the external head to such an extent that the head-end of the lock cylinder could be pushed through aperture 30 of panel 20.

Figure 3:
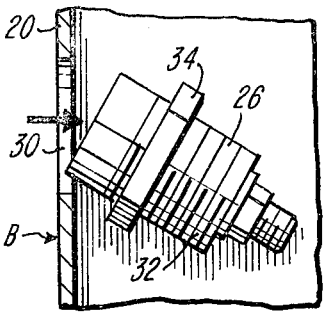
FIG-3 (PRIOR ART)
FIG. 3 illustrates the manner in which the prior art lock of FIGS. 1 and 2 is rendered ineffective as the lock cylinder is introduced into the interior of the coin box after the external head of the lock has been removed.

However, as a practical matter, the presence and utilization of hardened collar 40 in association with the external head 24 of a cylinder lock greatly facilitated rather than deterred the unauthorized removal of a lock from its front panel 20 by means of the cutting action of a hollow mill or hole-saw 50, the teeth 52 of which were literally guided by the external head receptive opening of the collar whereby to cut away the entire outer cylindrical portion of external head 24 of the lock, as illustrated in FIG. 2, after which the lock, per se, was free to be pushed through aperture 30 into the interior of the coin box, drawer or compartment, as illustrated in FIG. 3. The cutting action imparted to external head 24 by the hole-saw effectively reduced the diameter of the external head as illustrated in FIG. 3 without damage to the outer surface B of panel 20, since the cutting edge of the hole-saw engaged the forward surface D of flange 46 of the collar when the external head was reduced in diameter to pass through aperture 30.

Figure 5:
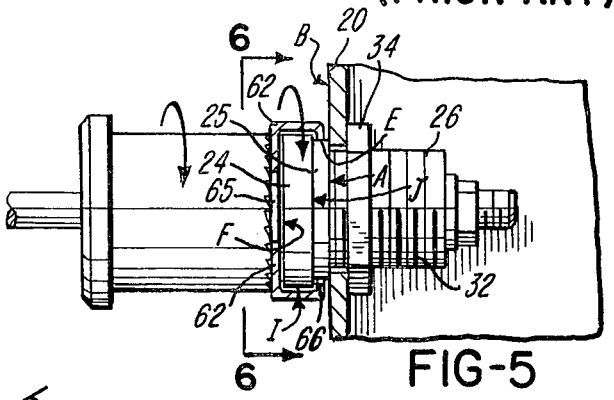
FIG. 5 is a view taken on line 5—5 of FIG. 4.
Figure 4:
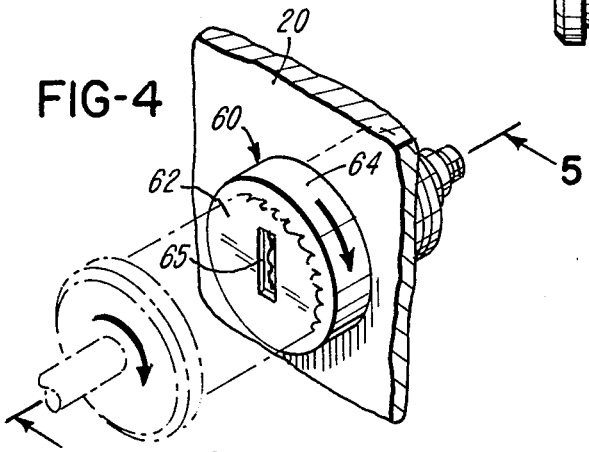
FIG. 4 is a perspective view similar to FIG. 1, illustrating a conventional key-actuated lock cylinder, the external head of which is provided with a hardened, rotatable, protective housing of the present invention.
Figure 6:
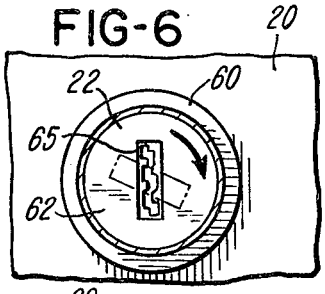
FIG. 6 is a view taken on line 6—6 of FIG. 5.
Figure 7:
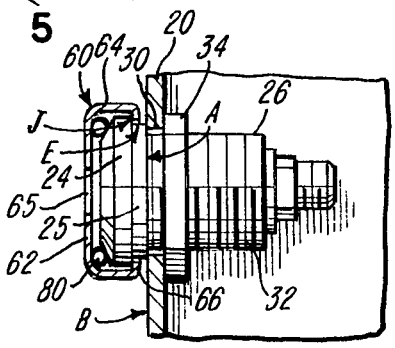
FIG. 7 is a view similar to FIG. 5 illustrating a modification of the inventive concept.

With particular reference now to FIGS. 4–6, the numeral 60 denotes a hardened, protective housing which is rotatably secured to and anchored on external head 24 of the lock cylinder.

The hardened protective housing literally encases the external head 24 of the lock whereby the external head is completely protected from the filing or chipping action of thieves and vandals, and since the hardened protective housing is rotatably secured relative to head 24 of the lock, any efforts to reduce the diameter of the lock head by utilizing a hollow mill or hole-saw will be thwarted by reason of the fact that the hardened protective housing will merely rotate at the speed of the hollow mill or hole-saw on and around external head 24 of the lock.

Figure 10:
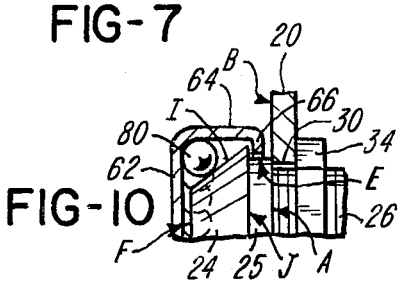
FIG. 10 is an enlarged view of the upper left corner of FIG. 7.
Figure 11:
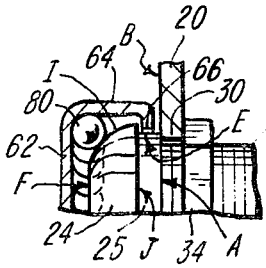
FIG. 11 is a view similar to FIG. 10, from which it differs in the shape of the external head of the lock cylinder.

With particular reference to FIGS. 5, 10 and 11, its will be noted that the external head 24 includes front, rear and intermediate surfaces F, A and I respectively. The front surface F is provided with a key-receptive aperture, the rear surface A projects at right angles from the body portion 26 to provide an abutment which bears against the front face B of the mounting panel 20, and the intermediate surface I extends between the said front and rear surfaces.

In FIG. 5 the intermediate surface I is substantially parallel with the longitudinal axis of the lock cylinder 26, whereby the overall external shape of head 24 is rectangular. In FIG. 10 the intermediate surface I is tapered downwardly from a maximum diameter to a minimum diameter at front surface F. In FIG. 11 the intermediate surface I is rounded as it approaches front surface F.

It should be understood that the external heads as illustrated in FIGS. 5, 10 and 11 are merely exemplary of the contour of some of the external heads of cylinder locks presently in widespread use.

In order to accommodate the hardened, protective housing 60, an annular groove 25 is provided in the rear portion of the intermediate surface I of the external head 24, said groove having an axial surface E which is disposed outwardly of the outer surface of the lock cylinder 26 and outwardly of aperture 30 of panel 20. Said groove has a transverse surface J which is spaced forwardly of surface A of the external head by a dimension to snugly though slideably receive the rear, inturned wall 66 of the protective housing 60.

The protective housing includes a front wall 62 which completely covers the front surface F of the external head 24, except for the presence of a key-receptive aperture 65 therein. The numeral 64 designates the intermediate wall of the housing.

Walls 66, 62 and 64 of the housing are disposed in overlying relationship with a corresponding surface J, I and F of the external heads 24, wherein the relationship of said walls to said surfaces is such that the housing can be freely rotated about the external head of the cylinder lock, but with a minimum of clearance between corresponding walls and surfaces; in other words, the housing is not loosely secured to the external head.

In the preferred embodiment of the invention the spacing between adjacent surfaces of inturned wall 66 and surface B of the apertures panel 20 is such as to preclude the introduction of a saw blade between said surfaces. If an attempt be made to remove the external head 24 by means of such sawing the housing will rotate first in one direction and then in the other direction with each advance and return stroke of the saw blade, and although the front surface of panel 20 will be severely disfigured, the protective housing will effectively prevent head 24 from being severed from the forward end of the cylindrical lock body.

The protective housing is associated with the external head before the lock is mounted in aperture 30 of panel 20. Rear wall 66 of the housing is inturned by any suitable means, whereby to be permanently secured and anchored to the external head of the lock cylinder.

Each lock cylinder is secured to a panel such as 20 by means of an internally threaded retaining nut 34 which draws the rear surface A of the external head tightly against surface B adjacent aperture 30 of the panel.

It is important that housing 60 be hardened to such a degree, such as, by way of example, by being heat treated to 55°–58° C. to resist drilling, cracking, filing and the like.

The presence of housing 60 not only shields external head 24 from a reduction in diameter by reason of filing and/or chipping, but it also presents an outer, forward surface which cannot be drilled. If subjected to the action of a hollow mill or hole-saw the entire housing will merely rotate about and on the external head at the rate of rotation of the hole-saw, etc.

Figure 8:
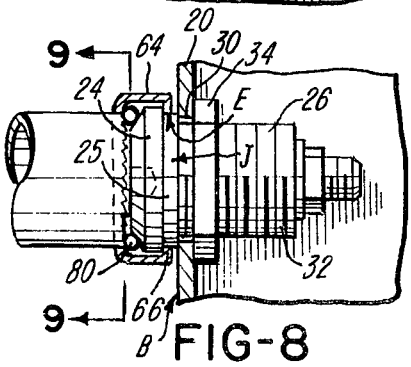
FIG. 8 is a view similar to FIG. 7 illustrating the relationship of the cutting edge of a hollow mill or hole-saw with respect to the spherical members which are interposed between the out portion of the external head of the lock cylinder and the rotatable housing.

In the unlikely event that vandals should succeed in locking the housing against rotation, and in the unlikely event that the front surface of the housing could be cut away by a hollow mill, hole-saw, or the like, as illustrated in FIG. 8, any further access of the cutters to or toward the "housed" external head 24 of the lock cylinder is effectively precluded by means of a plurality of hardened bearing balls or spheres, 80, the hardness of which is such as to literally destroy the cutting edges of a hollow mill, hole-saw, or the like.

In the embodiment illustrated in FIG. 5 the hardened protective housing is permanently and rotatably secured to external head 24, whereas in FIGS. 7–11 hardened ball bearings 80 are interposed around the forward periphery of the external head, between said head and the intersecting of the front and intermediate walls 62 and 64 of the housing.

The relationship of the hardened ball bearings is such that portions of said balls are disposed in axial alignment with those peripheral portions of the external heads 24 which must be removed, or reduced in diameter in order to pass inwardly through aperture 30 of panel 20. Since the hardened balls will effectively prevent any cutting action by the teeth of a hole-saw, or the like, the enlarged external head of the lock cylinder will remain intact and the effectiveness of the lock unimpaired.

Figure 9:
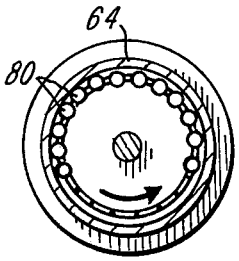
FIG. 9 is a view on line 9—9 of FIG. 8.

To summarize, in FIGS. 7–11 hardened ball bearings 80 are disposed between adjacent surfaces of the hardened protective housing 60 and the external head 24 of the lock cylinder, said hardened ball bearings providing additional anti-theft characteristics to the device, since, as illustrated in FIGS. 8 and 9 if, by chance, a thief should succeed in cutting and opening through the outer surface 62 of the hardened protective housing by means of a hollow mill or hole-saw, the teeth of such a mill or hole-saw would be rendered ineffective for any further cutting action en route to external head 24 of the lock, upon contact with the cutting edges of the mill or hole-saw with the hardened ball bearings 62.

In FIG. 10, external head 24 of the lock cylinder is tapered as at 66, in which event the hardened ball bearings 62 assume the relationship illustrated.

In FIG. 11, the ball bearings are disposed between the inner curved, corner-portion 70 of the protective housing 60 and the outer curved corner 72 of the external head 24.

From the foregoing it will be noted that I have provided a simple yet highly effective means for precluding the unauthorized removal of a lock from the panel of a coin box, drawer or compartment in which it was originally mounted for providing key-controlled access to the interior of such a box, drawer or compartment.

What is claimed is:

1. A key-activated cylindrical lock which comprises an elongate substantially cylindrical body portion, said body portion passing through an aperture defined in a panel to be mounted on that panel, an external head on the forward portion of said body portion the diameter of which is greater than the diameter of said body portion, said external head including front, rear and intermediate surfaces, said front surface having a key-receptive opening therein, said rear surface extending outwardly at right angles from said body portion, and said intermediate surface extending between said front and rear surfaces, said external head having peripheral portions thereof abutting a front surface of the panel in which the lock is mounted to prevent the lock from passing inwardly through the panel via the aperture defined therein, a hardened, protective housing for said head, said housing including front, rear and intermediate walls each of which are disposed in overlying relationship with a corresponding surface of the said external head, said front wall having a key-receptive opening therein, means rotatably securing said housing to said head, and a plurality of hardened ball bearings interposed between corresponding portions of the external head and housing, said ball bearings serving to space portions of the front and intermediate surfaces of the external head from corresponding adjacent portions of the front and intermediate walls of the housing, said ball bearings being disposed in spaced axial alignment with the periphery of the cylindrical body portion of the lock and in axial alignment with sections of said external lock head peripheral portions which must be disfigured in order to pass the lock inwardly through the aperture defined in the panel to dismount the lock from the panel thereby defeating the lock.

2. A lock as called for in claim 1, wherein the means for rotatably securing the said housing to the said external head, comprises an annular groove in the rear portion of the intermediate surface of the head into which groove the rear wall of the housing

3. A lock as called for in claim 1, wherein the front wall of the said housing is heat treated to 55°–58° C.

4. A lock as called for in claim 2, wherein the rear wall of said housing is crimped into said annular groove.

5. A lock as called for in claim 1, wherein the key-receptive opening in the front wall of said housing is dimensioned to accommodate the cross-sectional configuration of the key to said lock.

6. A key-activated lock comprising:

an elongate body mounted on a panel and passing through a lock receiving aperture defined in such panel;

a head portion on one end of said elongate body having a peripheral dimension larger than the peripheral dimension of said lock receiving aperture, said head portion having a panel abutting section abutting the panel adjacent said aperture to prevent said head portion from passing through said aperture;

a protective housing rotatably mounted on said head portion to cover said head portion and having an inner surface spaced from said head portion to define a gap between said head portion and said protective housing;

a plurality of ball bearings mounted in said gap to correspond to said head portion panel abutting section, said ball bearings each having a size so that said plurality of ball bearings forms a protective shield located in front of and covering said head portion panel abutting section so that said ball bearings protect said head portion panel abutting section from that disfigurement required to free said panel abutting section from abutting contact with a panel thereby permitting said head portion to move through said aperture whereby the lock may be dismounted from a panel and thereby defeated.

7. The lock of claim 6, wherein said head portion has a tapered outer surface on which said ball bearings are mounted.

8. The lock of claim 6, wherein said head portion has an arcuate outer surface on which said ball bearings are mounted.

9. The lock of claim 6, wherein said protective housing includes a front section and a top section.

10. The lock of claim 9, wherein said ball bearings contact both said protective housing front section and said protective housing top section.

11. The lock of claim 6, wherein said elongate housing is cylindrical, said aperture is circular, said head portion is circular and said abutting section is annular.

12. The lock of claim 11, wherein said ball bearings surround said head portion in a circle having the center thereof located on the longitudinal centerline of said body.

* * * * *